US006321520B1

(12) United States Patent
De Angelis

(10) Patent No.: US 6,321,520 B1
(45) Date of Patent: Nov. 27, 2001

(54) SHEATHED SYNTHETIC FIBER ROBE AND METHOD OF MAKING SAME

(75) Inventor: Claudio De Angelis, Lucerne (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/488,290

(22) Filed: Jan. 20, 2000

(30) Foreign Application Priority Data

Jan. 22, 1999 (EP) ..... 99810050

(51) Int. Cl.[7] ..... D02G 3/36
(52) U.S. Cl. ..... 57/223; 57/211; 57/232
(58) Field of Search ..... 57/210, 211, 224, 57/225, 230, 231, 232, 250, 258, 234

(56) References Cited

U.S. PATENT DOCUMENTS 3,395,530 * 8/1968 Campbell ..... 57/231
4,022,010 * 5/1977 Gladenbeck et al. ..... 57/231
4,299,884 * 11/1981 Payen ..... 428/377
4,550,559 11/1985 Thomson .
5,526,552 6/1996 De Angelis .
5,566,786 10/1996 De Angelis et al. .
5,881,843 * 3/1999 O'Donnell et al. ..... 187/254
6,164,053 * 12/2000 O'Donnell et al. ..... 57/232

* cited by examiner

*Primary Examiner*—Danny Worrell
(74) *Attorney, Agent, or Firm*—MacMillan, Sobanski & Todd, LLC

(57) ABSTRACT

A sheathed synthetic fiber rope includes concentric layers of load-bearing synthetic fiber strands, preferably of aramide fibers, with an outermost layer of strands having anchoring strands permanently fastened to a sheath extruded onto the outermost layer. The anchoring strands can be formed of weldable or vulcanizable material. Alternatively, a polyurethane jacket surrounding each of the outermost layer strands can be used to permanently fasten the sheath.

14 Claims, 2 Drawing Sheets

SHEATHED SYNTHETIC FIBER ROBE AND METHOD OF MAKING SAME

BACKGROUND OF THE INVENTION

The present invention relates a sheathed synthetic fiber rope, preferably of aromatic polyamide, and a process for manufacturing it.

In materials handling technology, especially on elevators, in crane construction, and in open-pit mining, moving ropes are an important element of machinery and subject to heavy use. An especially complex aspect is the loading of driven ropes, for example as they are used in elevator construction and for suspended cable cars. In these instances the lengths of rope needed are large, and considerations of energy lead to the demand for smallest possible masses. High-tensile synthetic fiber ropes, for example of aromatic polyamides or aramides with highly oriented molecule chains, fulfil these requirements better than steel ropes.

Such a sheathed synthetic fiber rope has become known from the European Patent document 0 672 781 A1. There, the synthetic sheath is applied by extrusion in such a manner that a large surface of adhesion to the strands is formed. However, when the rope bends on the rope sheave or pulley the strands perform compensatory movements which, under certain circumstances, can cause relative movement of the strands of different layers of strands. These movements are greatest in the outermost layer of strands and particularly when the drive torque is transferred by friction to the section of rope lying in the angle of wrap of the rope sheave, can cause the sheath to lift off and form pile-ups. Such a change in the structure of the rope is undesirable because it can cause the rope to have a short service life. The same applies to ropes wound on drums as they are used in mining.

The problem underlying the invention is that of proposing a sheathed synthetic fiber rope with a long service life, as well as a method for producing such a rope.

SUMMARY OF THE INVENTION

The present invention concerns a synthetic fiber rope having a stranded core surrounded by an intersheath. A covering layer of stands is laid on the intersheath and the covering layer is surrounded by a rope sheath.

The advantages resulting from the invention consist of a lasting bonding of the sheath in the outermost layer of strands. In addition to the former adhesive bonding to as large a contact surface as possible of the outermost layer of strands, according to the invention the sheath is fastened with anchoring means which are structurally anchored in the outermost layer of strands. Especially when the join is in one piece, the bonding forces between the sheath and the anchoring means correspond to the strength of the material of the anchoring means, and are thereby many times greater than conventional adhesive forces. If the anchoring means are connected to the outermost layer of strands by positive fit, separation of the sheath is then only possible with accompanying damage to the aramide fiber strands.

As a further advantage of integrating the anchoring means into the rope structure of the outer layer of strands in combination with the single piece bonding to the sheath, for example bonding with adhesive, as the rope passes over the traction sheave the anchoring means follow the movement and/or deformation of the outermost layer of strands. By appropriate selection of a material with suitable elastic deformability, the forces acting in the layer of aramide fibers and, as a result of the bending load, in the sheath can be mutually balanced out, thereby preventing relative movement between the sheath and the layer of strands.

In a further development of the invention, the anchoring means and the sheath are made of weldable or vulcanizable materials. This choice of materials makes it possible to join the anchoring means and the sheath with no additional bonding agent. At the same time, the joint is permanent, displays material behavior identical to that of the joined parts themselves, and is therefore equivalent to a single piece construction of the anchoring means and the sheath. The joint is particularly homogeneous if the anchoring means and the sheath are made of identical material. The uniform material parameters then occurring make-it simpler to join the parts to be joined with uniform molecular bonding.

In addition to the functional advantages achieved by the invention, manufacturing sheathed synthetic fiber ropes according to the invention can be done simply, and with minimal modification to conventional rope laying machines. Over a rope core manufactured in known manner, load-bearing fiber strands with anchoring means are laid in the outermost layer of strands. The fiber strands are then thermally or chemically pre-treated before the sheath of synthetic material is applied, and the fiber strands then form a molecular bond with the means of anchoring. With conventional rope laying machines it is adequate to retrofit a pre-treatment station, apart from which there is only adjustment work to be done.

If the anchoring means and the sheath are welded to each other, essentially a heating device must be provided to heat the anchoring means so that when the sheath is extruded, permanent fusion of the sheath and the anchoring means takes place.

In a further preferred alternative process the sheath is vulcanized onto the outermost layer of strands. In this embodiment a substrate is applied to the anchoring means by use of a suitable pre-treatment station which slightly corrodes them, and in this way prepares them for molecular interlinking with the extruded sheath.

In a preferred embodiment of the invention the anchoring means take the form of one or more anchoring strands which together with load-bearing aramide fiber strands are laid into the outermost layer of strands. The twisted rope structure resulting from the helical twisting of the strands around each other already provides in a simple manner a positive fit of the anchoring strands on the outermost layer of strands. The anchoring of the sheath can be adjusted via the number of anchoring strands laid in the outer layer. A particularly good positive fit is achieved with this embodiment if the anchoring strands have a smaller diameter than the load-bearing aramide fiber strands. The circumference of each anchoring strand is squeezed between two aramide fiber strands of larger diameter, and thereby anchored in the layer of strands. Pre-manufactured anchoring strands can be processed together with the aramide fiber strands by the same rope-laying machine.

Furthermore, the anchoring means can take the form of anchoring fibers that are twisted together with aramide fibers and fixed to them to form load-bearing strands for the outermost layer of strands. The anchoring fibers are arranged in the outermost layer of fibers of the strands, and are also bonded as a single piece to the sheath, which is subsequently extruded on to them. Having a large number of such anchoring strands creates a large total bonding area between the sheath and its anchoring which strengthens the bond and also lengthens the service life of the rope.

Furthermore, the thin anchoring strands can be heated to melting temperature in a short space of time and with relatively low expenditure of energy, as a result of which this embodiment is advantageous for continuous extrusion of the sheath onto the rope.

The synthetic fiber rope according to the invention affords advantages in elevator installations, for example, where it connects the car frame of a car guided in an elevator hoistway to a counterweight. For the purpose of raising and lowering the car and counterweight, the rope passes over a traction sheave that is driven by a drive motor. As the synthetic fiber rope according to the invention passes over the traction sheave, no relative movement occurs between the rope sheath and the synthetic fiber rope.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
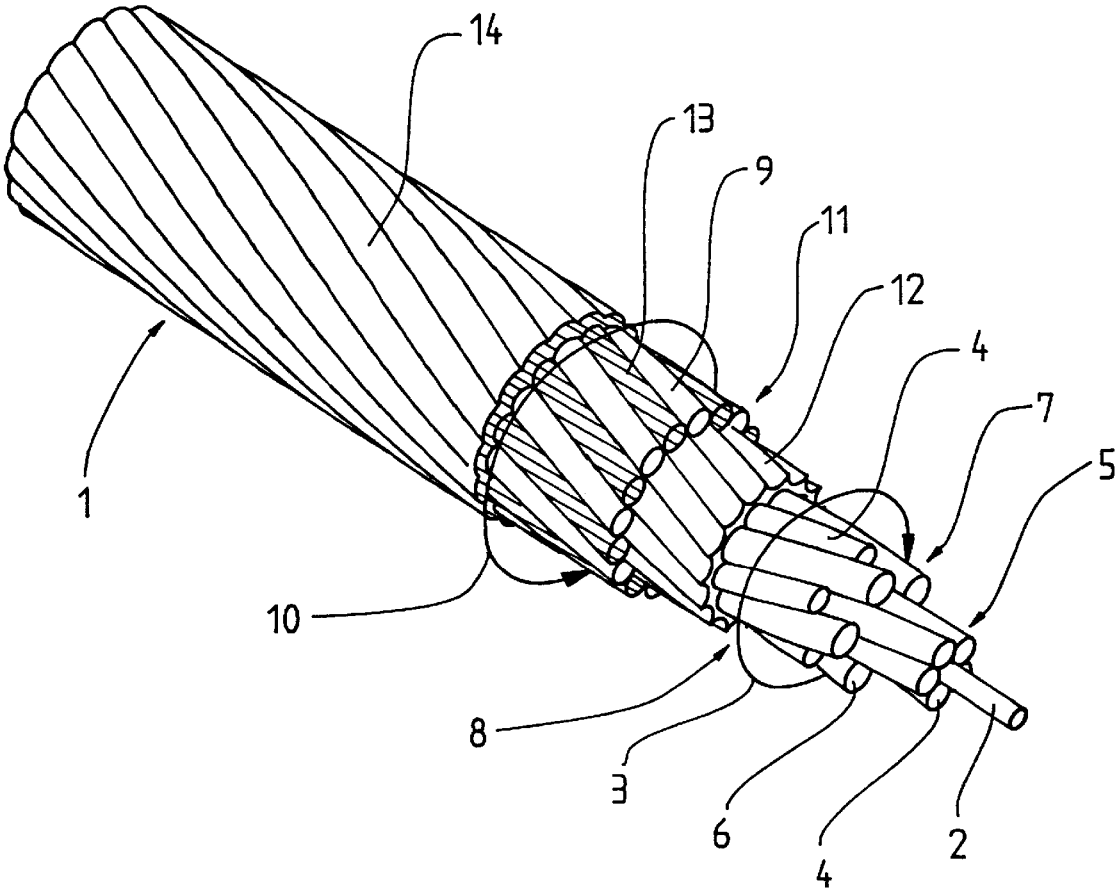
FIG. 1 is a perspective view of a first exemplary embodiment of a drive rope with anchoring strands according to the present invention.

FIG. 1 shows a first exemplary embodiment of a sheathed rope 1 according to the present invention. The rope 1 is constructed of a core strand 2, about which a plurality of strands is laid in a first direction of lay 3. Five identical strands 4 of a first layer of strands 5 are laid helically about the core strand 2. The first layer 5 is covered by ten strands of a second layer of strands 7 are laid in parallel lay in a balanced ratio between the direction of twist and the direction of lay of the fibers and strands. The second layer includes five of the strands 4 alternated with five larger diameter strands 6. A different number of laid strands can be selected to correspond to the specific requirements and is not determined by the number in this exemplary embodiment. The second layer of strands 7 is surrounded by a covering layer of strands 9. Load-bearing strands 2, 4, 6 and 9 that are used for the rope 1 are twisted or laid from individual aramide fibers and treated with an impregnating substance, for example polyurethane solution, which protects the aramide fibers.

The strands 2, 4 and 6 form a rope core 8 that is surrounded by an intersheath 12 of polyurethane or polyester, onto which the covering layer of strands 11 is laid. The intersheath 12 is extruded onto the rope core 8 immediately before the covering layer of strands 11 is laid. It prevents contact between the covering layer of strands 11 and the second layer of strands 7, and thereby wear of the strands 4, 6 and 9 being caused by their rubbing against each other when the rope 1 runs over the traction sheave and relative movement then occurs between the strands 4, 6 and 9. The intersheath 12 also serves to transfer internal moments between the rope core 8 and the covering layer of strands 11.

The covering layer of strands 11 is laid in a second direction of lay 10 that is opposite to the first direction of lay 3. When the rope 1 is loaded longitudinally, the covering layer of strands 11 gives rise to a torque opposite in direction to that of the parallel laid rope core 8.

A rope sheath 14 of polyurethane surrounds the covering layer of strands 11 and 15 ensures the desired coefficient of friction on the traction sheave. Furthermore, the polyurethane is so resistant to abrasion that no damage occurs as the rope 1 passes over the traction sheave. By means of, for example, welding, vulcanization, or use of adhesive, the rope sheath 14 is bonded in one piece to anchoring strands 13 of polyurethane. Here, by way of example, nine of these polyurethane strands 13 alternating with nine aramide fiber strands 9, and each lying between two adjacent aramide fiber strands 9, are laid together to form the covering layer of strands 11.

In the FIG. 1, the aramide fiber strands 9 and the polyurethane strands 13 are shown equally thick, but the positive fit of the polyurethane strands 13 to the covering layer of strands 11 can be improved further if the polyurethane strands 13 are thinner than the aramide fiber strands 9. The circumferences of the thinner polyurethane strands 13 are squeezed between the adjacent aramide fiber strands 9 of larger diameter and thereby pressed in a radial direction onto the intersheath 12.

The rope sheath 14 is extruded onto the covering layer of strands 11 in a pass-through process. During the extrusion process, the flowable synthetic material is pressed into all the interstices in the surface of the covering layer of strands, so that a large surface of adhesion is formed. Before extruding the rope sheath 14, the polyurethane strands 13 are heated to melting temperature so that during extrusion the rope sheath 14 and the polyurethane strands 13 are welded together. The permanent single-piece bonding thereby created provides the rope sheath 14 with a permanent connection to the high-tensile rope 1 via the improved positive fit of the polyurethane strands to the covering layer 11. Furthermore, the sheath can be vulcanized onto the outermost layer of strands wherein a substrate is applied to the anchoring means by use of a suitable pre-treatment station which slightly corrodes them, and in this way prepares them for molecular interlinking with the extruded sheath.

Figure 2:
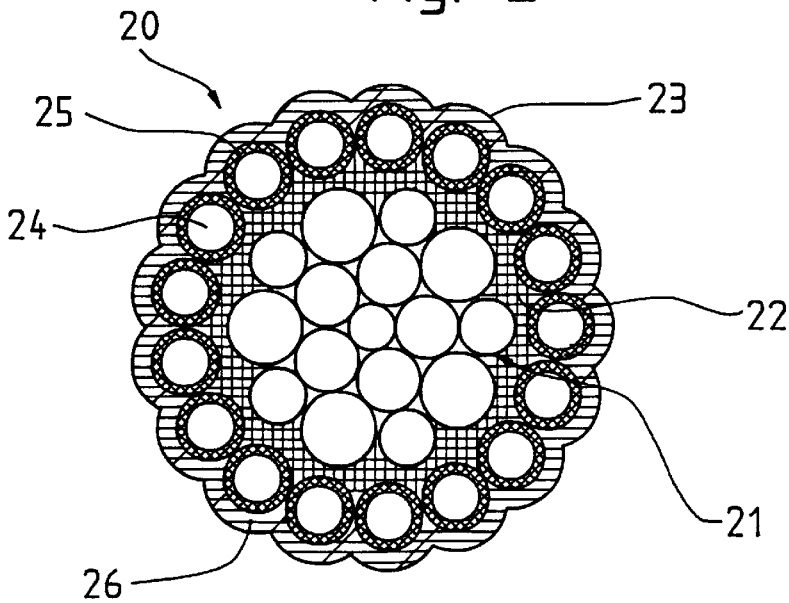
FIG. 2 is a cross-sectional view of a second exemplary embodiment of the drive rope with enveloping of the strands according to the present invention.

The rope sheath can also be extruded in two layers. The foregoing description then applies identically to the first layer of sheath applied. FIG. 2 shows a cross-sectional view of a second exemplary embodiment of a sheathed rope 20 according to the invention. With regard to function and construction, a rope core 21 and an intersheath 22, that is firmly bonded to it, correspond to relative parts of the first exemplary embodiment described above. A covering layer 23 of seventeen aramide fiber strands 24 is laid onto the intersheath 22. Each individual aramide fiber strand 24 is given a separate, seamless jacket 25 of polyurethane. The aramide fiber rope 20 described so far is surrounded by a rope sheath 26. The rope sheath 26, as also the jacket 25 surrounding the aramide strands 24, consists of thermoplastically formable polyurethane and this material is welded in one piece to the covering layer of strands 23 along the corresponding external surface of the jacket 25. Via these permanent molecular bonds the rope sheath 26 is bonded with positive fit to the aramide fiber rope 20. In this exemplary embodiment too, anchoring means in the form of the jacket 25 are first anchored in the rope structure with positive fit, and immediately prior to extrusion of the rope sheath 26 are permanently bonded to the rope sheath 26 by heating, bonding with adhesive, lightly corroding or vulcanizing.

Figure 3:
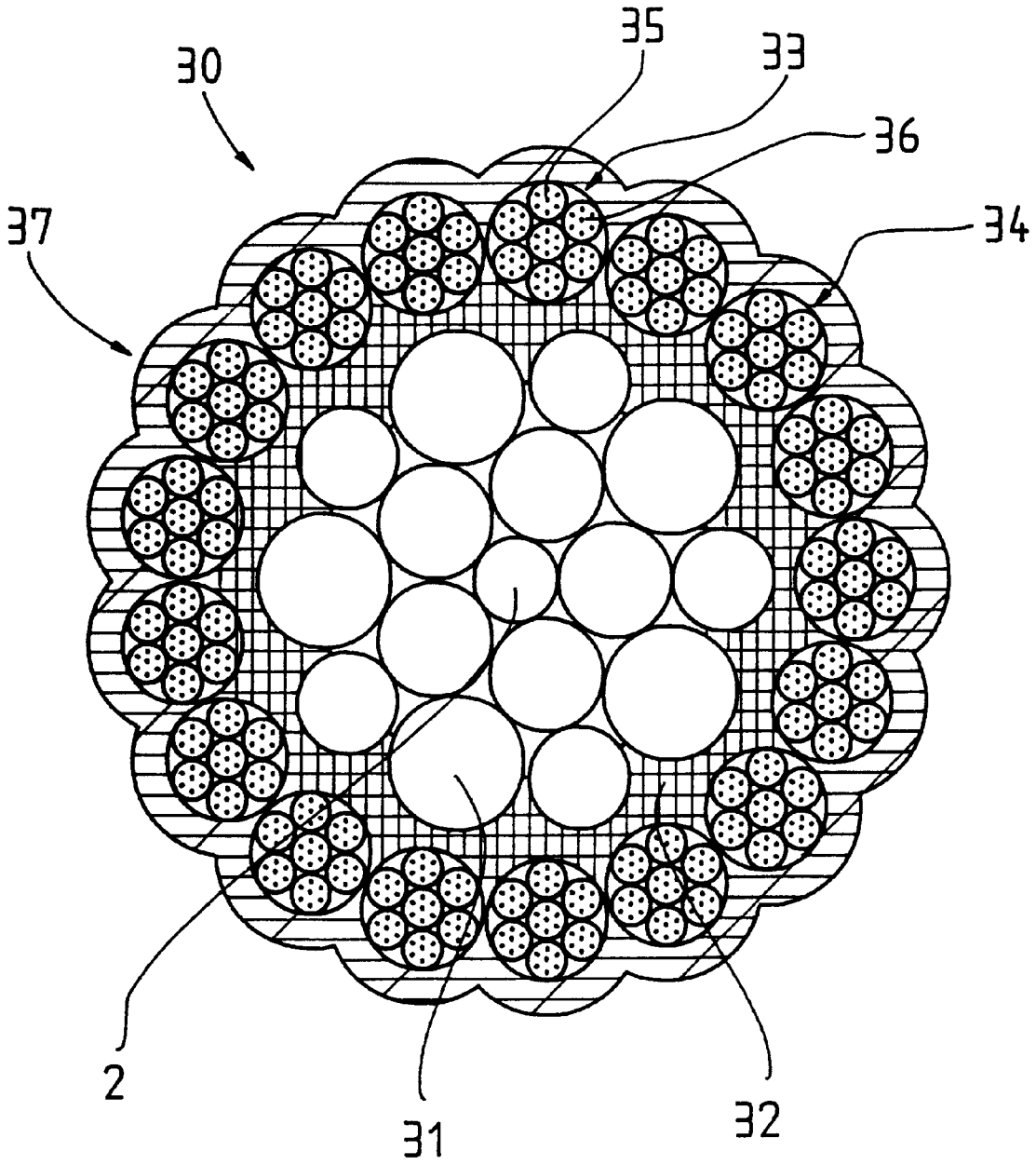
FIG. 3 is a cross-sectional view of a third exemplary embodiment of the present invention with anchoring fibers.

In FIG. 3, an aramide fiber rope 30 is shown as a third exemplary embodiment of the invention. A rope core structure 31, an intersheath 32 surrounding it, and a number of strands 33 of a covering layer of strands 34 are again identical to those in the two exemplary embodiments described above. A rope sheath 37 surrounds the covering layer of strands 34 to which it is joined with positive fit. The strands 33 each are formed of a plurality of polyurethane fibers 35 and can include at least one aramide fiber 36. The fact that the strands 33 are wound helically around the intersheath 32 ensures that the polyurethane fibers 35 at least in part lie against the surface adjacent to the rope sheath 15452 37. Shortly before extruding the rope sheath 37, the polyurethane fibers 35 are heated and fuse with the rope sheath 37 that is pressed on tightly. As a component of the strands 33, the polyurethane fibers 35 are bonded with positive fit to the strand structure forming the covering layer of strands 34.

Consequently, the rope sheath 37 which is bonded in one piece to the polyurethane fibers 35 is also permanently anchored with positive fit to the aramide fiber rope 30 via a large number of such polyurethane fibers 35. Moreover, the described exemplary embodiments of the invention can be systematically combined with each other to create a specific desired fastening of the sheath.

As well as being used as a means of suspension in elevator installations, the rope according to the present invention can be used in a wide range of equipment for handling materials, examples being hoisting gear in mines, building cranes, indoor cranes, ship's cranes, aerial cableways, and ski lifts, as well as a means of traction on escalators. The drive can be applied by friction on traction sheaves or Koepe sheaves, or by the rope being wound on rotating rope drums. A hauling rope is to be understood as a moving, driven rope, which is sometimes also referred to as a traction or suspension rope.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A synthetic fiber rope comprising:

a rope core formed of a plurality of load-bearing synthetic fiber strands laid together in layers;

an outer layer of load-bearing synthetic fiber strands laid on said rope core and including anchoring means, said anchoring means being at least one of at least one anchoring strand laid between a pair of said outer layer strands and at least one anchoring fiber included in one of said outer layer strands; and a sheath surrounding said outer layer of strands and permanently fastened to said anchoring means.

2. The rope according to claim 1 wherein said anchoring means and said sheath are fastened together by at least one of welding, vulcanization and adhesive.

3. The rope according to claim 1 wherein said sheath is formed of a polyurethane material.

4. The rope according to claim 1 wherein said anchoring means is formed of a polyurethane material.

5. The rope according to claim 1 wherein said anchoring means includes an anchoring strand laid between each pair of said outer layer strands.

6. The rope according to claim 1 wherein said outer layer strands are formed of aramide material.

7. The rope according to claim 1 wherein said anchoring means is a polyurethane jacket surrounding each of said outer layer strands.

8. The rope according to claim 1 wherein said anchoring means is a plurality of anchoring fibers and said outer layer strands include at least one aramide fiber and at least one of said anchoring fibers.

9. A synthetic fiber rope comprising:

a core strand;

an inner layer of load-bearing synthetic fiber strands laid about said core strand;

an intersheath surrounding said inner layer of strands;

an outer layer of load-bearing synthetic fiber strands laid on said intersheath and including anchoring means, said anchoring means including at least one anchoring strand laid between a pair of said outer layer strands; and a sheath surrounding said outer layer of strands and permanently fastened to said anchoring means.

10. A method of making a synthetic fiber rope comprising the steps of:

a. providing a rope core;

b. laying a plurality of synthetic fiber strands and an anchoring means in an outer layer about the rope core, the anchoring means being formed as at least one of a plurality of anchoring strands alternated with the outer layer stands and a plurality of anchoring fibers included in the outer layer stands;

c. covering the outer layer of strands with a sheath; and d. permanently fixing the sheath to the anchoring means.

11. The method according to claim 10 wherein said step c. is performed by extruding polyurethane material onto the outer layer of strands.

12. The method according to claim 10 wherein said step d. is performed by heating the sheath and the anchoring means to a melting temperature.

13. The method according to claim 10 wherein said step d. is performed by heating the sheath and the anchoring means to a vulcanization temperature.

14. The method according to claim 10 wherein said step d. is performed by adhering the sheath to the anchoring means with an adhesive.

* * * * *